United States Patent [19]

Felix

[11] Patent Number: 4,909,027

[45] Date of Patent: Mar. 20, 1990

[54] MULTI-SPINDLE TEXTILE MACHINE MONITORING PROCESS AND APPARATUS

[75] Inventor: Ernst Felix, Uster, Switzerland

[73] Assignee: Zellweger Uster AG, Uster, Switzerland

[21] Appl. No.: 180,062

[22] Filed: Apr. 11, 1988

[30] Foreign Application Priority Data

Apr. 10, 1987 [CH] Switzerland ..... 1397/87

[51] Int. Cl.[4] ..... D01H 13/16; D01H 13/22; D01H 13/32

[52] U.S. Cl. ..... 57/264; 57/81; 57/265; 340/677

[58] Field of Search ..... 57/80, 81, 75, 261–265, 57/352; 340/677

[56] References Cited

U.S. PATENT DOCUMENTS

| | | | |
|---|---|---|---|
| 3,621,267 | 1/1971 | Dent | 57/264 X |
| 3,950,927 | 4/1976 | Kallman | 57/265 |
| 4,058,962 | 11/1977 | Spescha et al. | 57/81 X |
| 4,095,401 | 6/1978 | Mori et al. | 57/81 |
| 4,122,657 | 10/1978 | Felix | 57/81 |
| 4,160,360 | 7/1979 | Carvalho et al. | 57/81 |
| 4,168,604 | 9/1979 | Mannhart | 57/264 |
| 4,256,247 | 3/1981 | Loepfe | 57/81 X |
| 4,330,094 | 5/1982 | Mayer | 57/265 X |
| 4,399,648 | 8/1983 | Kato | 57/265 |
| 4,491,831 | 1/1985 | Sakai et al. | 57/264 X |
| 4,512,028 | 4/1985 | Stutz | 57/265 X |

FOREIGN PATENT DOCUMENTS

| | | | |
|---|---|---|---|
| 2134527 | 1/1973 | Fed. Rep. of Germany | 57/264 |

*Primary Examiner*—John Petrakes

*Attorney, Agent, or Firm*—Burns, Doane, Swecker & Mathis

[57] ABSTRACT

Successive groups of thread paths in multi-spindle textile apparatus are equipped with individual monitoring systems. In each system, a joint monitoring element (S,E,L) is provided which has a bundle of rays (L). The latter is moved transversely to the thread running direction, passes thereby over the production points (1–8) arranged in rows and is interrupted or attenuated at each production point by the respective thread. The shading of the bundle of rays caused thereby is assessed as criterion for the presence of the thread concerned.

The process makes possible an on-line production and quality monitoring on multi-spindle textile machines, for example ring spinning frames, with a reasonable expenditure.

15 Claims, 3 Drawing Sheets

MULTI-SPINDLE TEXTILE MACHINE MONITORING PROCESS AND APPARATUS

BACKGROUND AND FIELD OF THE INVENTION

In the textile industry, there are a whole variety of production machines on which operation is performed simultaneously at a plurality of work stations or production points. Examples which may be given are spinning frames, winding frames or twisting frames.

There is a need to monitor automatically each one of these production points with regard to production sequence and quality produced. From the point of view of the production sequence, thread breakage monitoring is desired in particular and, from the point of view of quality monitoring, determination of the thread cross-section and/or thread irregularity is desired. In the case of twisting frames, the twist cross-section is of interest in particular, as a check on whether all threads have been taken up in the twist.

The following text and claims always refer to "thread". This term is not to be understood as restrictive, but as representative for all spinning products, such as yarns, rovings, slubbings, twisted yarns, strands, filaments and the like.

The monitoring of all individual production points could in itself be accomplished by known means, but such has not yet been put into practice for reasons of cost. This is so since the plurality of production points only allows a minimum expenditure per production point in order that the outlay per frame remains within reasonable limits.

For thread breakage detection on ring spinning frames, recently systems have appeared on the market which have so-called traveler sensors. See for example U.S. Pat. No. 4,122,657. In this case, movement of the ring travelling on the entire side of a ring spinning frame can be detected with a single sensor. In terms of cost, this solution is reasonable for thread breakage detection. However, a measurement of further thread parameters is not possible, because the signal is generated by the rotating ring traveler and not by the thread itself. In addition, the time between the occurrence of a thread breakage and its detection is often much too long in the case of traveling sensors.

So far, no cost-effective solutions have been put into practice on ring spinning, twisting and such like frames for determination of the thread cross-section and/or the irregularity of the same directly at the production point.

SUMMARY OF THE INVENTION

It is an object of this invention to provide a process which makes possible production and quality monitoring of the work stations, e.g. the production points, on multi-spindle textile machines with a reasonable expenditure and with sufficiently quick response times to be reliably useful.

The invention relates to a process for the production and quality monitoring of the production points on multi-spindle textile machines, the production points being arranged in rows and the thread running at each production point assuming an at least approximately stretched position in the monitoring region.

The process according to the invention is characterized in that a joint monitoring element is provided in each case for at least two production points and has a bundle of rays oriented transversely to the thread running direction, in that the bundle of rays is moved transversely to the thread running direction and transversely to the joining axis of the individual production points (and thereby passes successively over the production points to be monitored and is interrupted or attenuated at each production point by the respective thread), and in that the shading of the bundle of rays caused by each thread is assessed as a criterion for the presence of the thread concerned and/or for its diameter.

The underlying idea of the invention is thus to monitor in each case a plurality of production points with a joint monitoring element, as a result of which the costs per production point are correspondingly reduced. The bundle of rays is preferably orientated obliquely to the joining axis of the individual production points and thus strikes the threads at the individual production points successively during its transverse movement, so that consecutively timed shading pulses are produced. It is essential for the accuracy and meaningfulness of the measurement that, at any one point in time, only one thread ever crosses the bundle of rays. In other words, the individual shading pulses are distinctly separated from one another and can thus be assigned definitely to the respective production points.

In the case of textile machines with a very large number (for example over one hundred) of production points in a row, it is appropriate not to provide a single monitoring element for the entire row of production points but to form in each case groups of production points with a joint monitoring element. The size and number of these groups is a question of judgment and is determined by practical parameters. For example, the frequency of the scanning of a certain production point has a bearing, and it is also to be taken into account that the light intensity will not suffice under certain circumstances if the distances between transmitter and receiver are too large. This last point does not, of course, apply to laser beams.

The invention also relates to an apparatus for implementation of the said process. The apparatus according to the invention is characterized in that the monitoring element has a transmitter for a bundle of rays and a receiver for the latter and is arranged in such a way that the bundle of rays is orientated obliquely to the joining axis of the production points and sequentially crosses the threads run at the individual production points during its transverse movement.

BRIEF DESCRIPTION OF THE DRAWINGS

The invention is explained in more detail below with reference to exemplary embodiments illustrated in the drawings, in which.

DETAILED DESCRIPTION OF PREFERRED EMBODIMENTS

Figure 1:
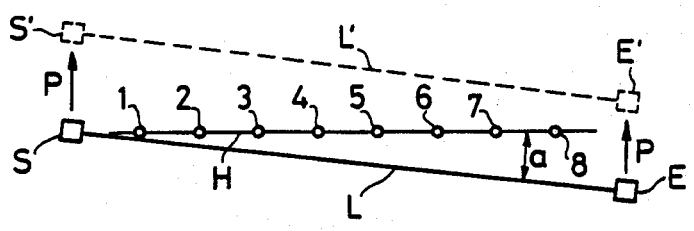
FIG. 1 is a diagrammatic plan view of a number of production points and an assigned monitoring device of a multi-spindle textile machine.

FIG. 1 shows a diagrammatic plan view of eight production points (e.g. thread paths at the output side of row of work stations) of a multi-spindle textile machine, symbolized by eight threads 1 to 8 running through these production points perpendicularly to the plan of the drawing. Assigned to these production points is a joint monitoring element, which has a transmitter S for a bundle of light L and a receiver E for the latter. Transmitter S and receiver E are arranged in such a way that the bundle of light L forms an acute angle a with the joining axis H of the production points 1 to 8 arranged in a row.

If it is then intended to monitor all eight production points 1–8 with the single monitoring element S, E, L shown, the bundle of light L must continuously scan the individual production points at a certain frequency. This scanning is performed by transmitter S and receiver E, and consequently also the bundle of light L. In other words, the monitoring element is moved from the initial position S, E, L shown in solid lines in the direction of the arrow P into the end position S', E', L' drawn in broken lines.

At a small angle a, the distance in the direction of the arrow P is relatively small, so that scanning in rapid succession is possible. This is a departure from a solution with a=90, that is, from the situation in which the movement of transmitter and receiver is along the joining axis H.

Figure 2:
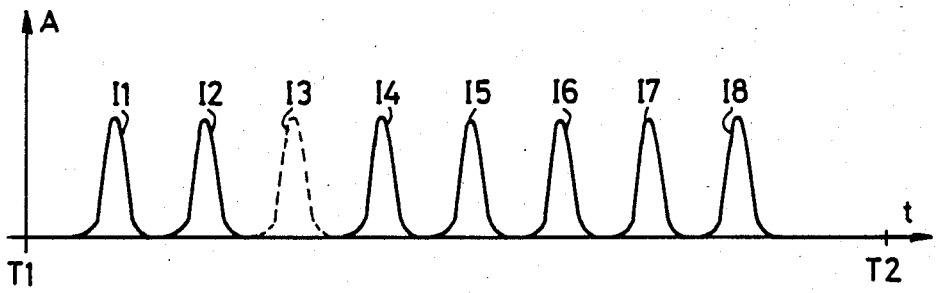
FIG. 2 shows a pulse diagram for functional explanation.

The scanning preferably takes place at constant speed. When the bundle of light L meets one of the threads 1–8 and is crossed by the latter, a shading pulse I occurs at the receiver E. FIG. 2 shows a corresponding pulse diagram, in which the time t between the initial position T1 and the end position T2 of the monitoring element is plotted on the abscissa and the shading A produced by the threads 1 to 8 is plotted on the ordinate. Each shading by one of the threads 1 to 8 is symbolized by a shading pulse I1 to I8. The size of the shading I1 to I8 is a measure for the diameter of the thread concerned. If there is no thread at the production point concerned, for example due to a thread breakage, no shading occurs and no shading pulse is registered.

This is indicated in FIG. 2 by the shading pulse I3 shown in broken lines. If this pulse does not occur, it means that no thread is present at the production point 3. Thus, in the way described, a single monitoring element can be used to monitor a whole series of threads, not only for thread breakage, but also (due to the relationship between size of the shading A and thread diameter), for properties associated with the thread diameter, such as for example irregularity and the like.

If the described movement of the monitoring element S, E, L is performed periodically, each production point and each of the threads 1–8 is scanned at a certain frequency. Since the threads, have, as a rule, moved on between two scans, a different point of the thread is always scanned. The known quality parameters, such as, for example, the variation coefficient of irregularity, the spectrogram, etc, can be calculated from a sufficient number of scanning points. An unbroken sequence of pulses is not necessary for this. Rather, interruptions are permissible since, with an "on-line" measurement of the type described, material and time are available for the evaluation.

In the case of twisted (plied) yarn, in various cases a check on the presence of all individual threads is necessary. If a single twisted thread is missing or there are an excessive number of twisted threads, the diameter of the thread changes, and thus the shading does as well. It can be determined from this that the number of individual threads in the twisted yarn is correct.

It is also conceivable that a different thread fineness is produced by a mix-up at a production point. In this case, the shading from the production point concerned is different from that produced with a thread of correct fineness. Consequently, production points with incorrect thread fineness can thus also be determined.

Thus, if the size of the shading is included in the evaluation, not only is it feasible to detect a thread breakage at favorable cost, but also a comprehensive quality monitoring of each individual production point can be achieved at the same time.

The number of production points assigned to a joint monitoring element S, E, L (FIG. 1) is variable within broad limits. The number, chosen as an example, of eight such production points is rather towards the lower limit. Of course, for economic reasons, it will be attempted to assign as many production points as possible to one monitoring element, their number being limited by the reliability of the assignment of a pulse to the corresponding production point. That means, in this context, that the shading pulses caused by the individual production points must be recognizably separated from one another. This is so since only then can each shading pulse I be assigned definitely to the associated production point.

Since this is dependent on several parameters, for example on the angle a between the light beam L and the joining axis H of the production points 1–8 (FIG. 1), and on the scanning frequency and on the diameter of the light beam L, no definitive statements can be made on the number of production points which can be monitored reliably and definitely by a single monitoring element. As a rule, however, at least sixteen production points should be possible. On a machine with 160 production points, for example, ten groups of sixteen production points each could be formed. Only a minimal outlay is then necessary on the individual groups, because the evaluation is preferably carried out centrally. In this way, low-cost systems can be constructed.

The number of production points may be further limited by problems of optics, since the light intensity decreases with the square of the distance of the receiver from the transmitter. Interfering light and noise can mask the wanted signal in this way. A considerable improvement is possible if the light is modulated in a known way. This allows extraneous effects to be eliminated.

Figure 3:
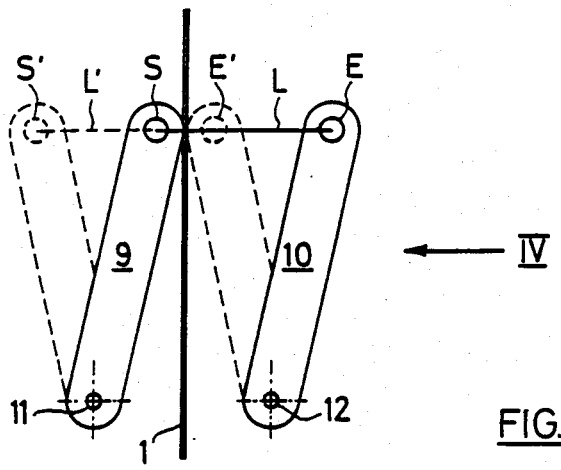
FIGS. 3 and 4 show two views of a first exemplary embodiment of a monitoring device according to the invention.
Figure 4:
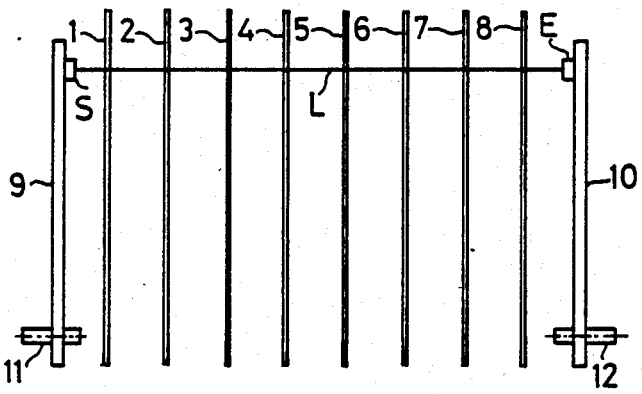

A number of exemplary embodiments of a movable monitoring element are explained below. FIGS. 3 and 4 show the first such exemplary embodiment, FIG. 3 showing a view of a row of threads of a production machine in the direction of the joining axis H of FIG. 1, and FIG. 4 showing a view of the direction of the arrow IV of FIG. 3.

According to the representation, the threads 1 to 8 are arranged in rows, along a straight line, as in FIG. 1. On one side of this group of production points and threads, on the left in FIG. 4, there is arranged a swivel arm 9 bearing the transmitter S and on the other side is arranged a corresponding swivel arm 10 bearing the receiver E. Each swivel arm is mounted on a corresponding fixed axis 11 and 12, respectively, and the joining line between these axes runs, like the light beam L in FIG. 1, obliquely to the row of threads 1–8.

If the two swivel arms 9 and 10 are then swivelled simultaneously and in the same direction into the position shown in broken lines, the movement indicated in FIG. 1 of transmitter, receiver and light beam from the position S, E, L into the position S', E', L' takes places and the described scanning of the individual production points occurs.

Figure 5:
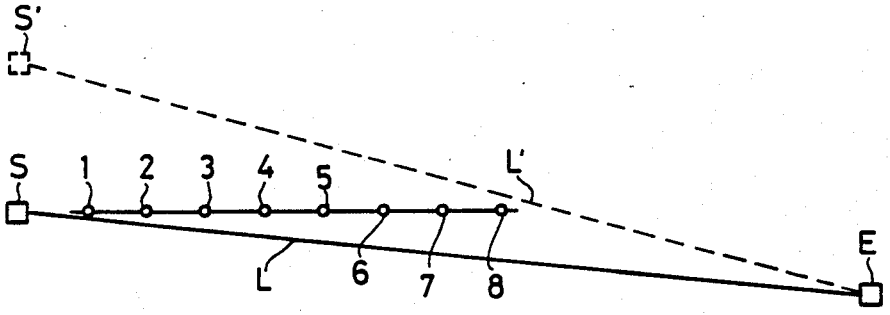
FIGS. 5 and 6 each show a variant of the arrangement illustrated in FIG. 1.

FIG. 5 shows a diagrammatic plan view of a variant of the arrangement illustrated in FIG. 1, in which only the transmitter S, but not the receiver E, is moved. A precondition for this is that the fixed receiver E has a relatively large distance from the neighboring production point 8, and that the movement distance of the transmitter S is approximately twice as large as in the case in the arrangement of FIG. 1. For this, only half of the elements, transmitter S and receiver E, must be moved. Hence, the synchronization of the movement of transmitter S and receiver E is dispensed with. It applies in principle for all examples that transmitter and receiver can in each case be interchanged.

Figure 6:
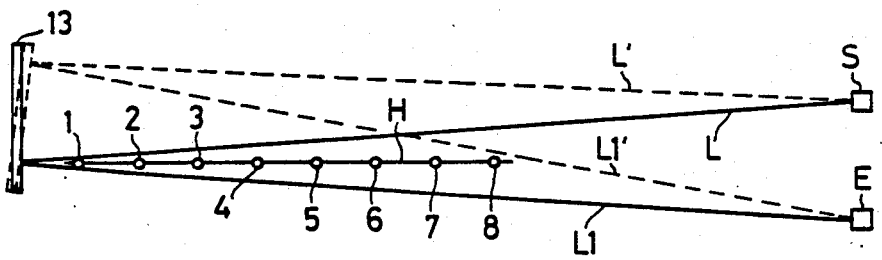

In FIG. 6, a diagrammatic plan view of a further variant of the arrangement of FIG. 1 is illustrated, in which a mirror is used for reflection of the light beam L. According to the representation, transmitter S and receiver E are arranged on the one side of a row of threads 1–8 to be monitored, and on the other side there is a swiveling mirror 13. In the initial position of the monitoring element S, E, L the light beam L emitted by the transmitter S is cast by the mirror 13, in its position represented by solid lines, as reflected beam L1 onto the receiver E, the reflected beam L1 having not quite yet crossed the thread 1. If, on the other hand, the mirror 13 assumes the position drawn in broken lines, a light beam L' emitted by the transmitter S passes as reflected beam L1' to the receiver E and just misses crossing the thread 8.

It is evident from this that, with a swivel movement of the mirror 13 between the two positions drawn, the light beam reflected by the mirror 13 to the receiver E experiences a continuous shift between the two positions L1 and L1' and thereby scans specifically the threads 1 to 8 of the row of threads to be monitored. At the same time, the necessary swiveling or rotating movement of the mirror 13 is extremely small compared with the displacement distances of transmitter S and/or receiver E required in the case of the arrangements illustrated in FIGS. 1, 3, 4 and 5. Such small movements do not necessarily require a mechanical drive, but can also be carried out quasi-mechanically, for example by means of bi-metal bending rods or piezoelectric components.

Of course, the exemplary embodiments described provide a person skilled in the art with a further range of possibilities of arranging for a light beam to pass transversely over a row of threads by means of moved light source and/or mirror. Of these, such possibilities in which a specifically moved part is not necessary for the movement of the light beam but an already existing movement of the textile machine can be utilized are especially interesting in particular.

Figure 7:
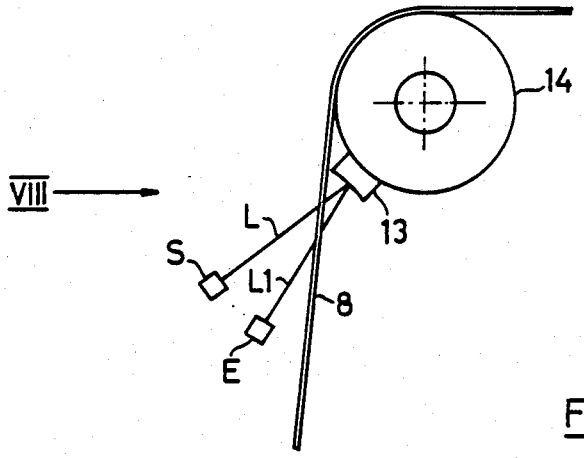
FIGS. 7 and 8 show two views of a further exemplary embodiment of a monitoring device according to the invention.
Figure 8:
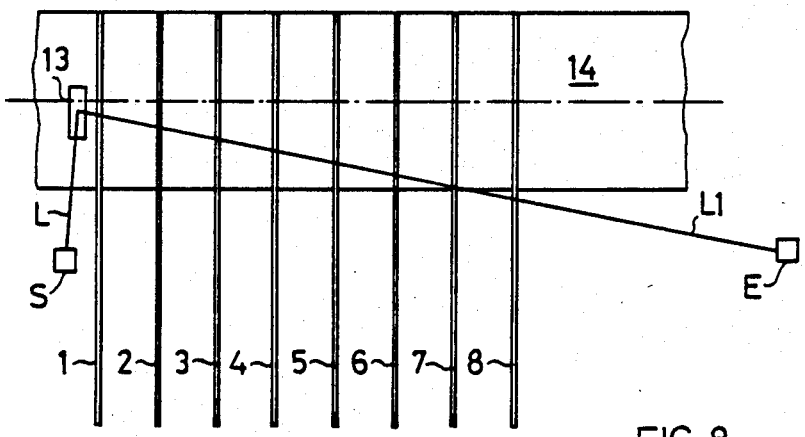

Such an arrangement is illustrated in FIGS. 7 and 8. Here, FIG. 7 shows a view in the direction of the axis H (FIg. 1) of a row of threads to be monitored, in the region of the so-called front roller of a ring spinning frame, and FIG. 8 shows a view in the direction of the arrow VIII of FIG. 7.

According to the representation, the threads 1 to 8 are lead over the rotatably driven front roller 14 of the drawing mechanism, and lie in a defined plane in the monitoring region. The monitoring element has, fundamentally, the layout illustrated in FIG. 6, with transmitter S, emitted light beam L, reflected light beam L1, moved mirror 13 and receiver E, with the difference that transmitter S and receiver E are arranged on different sides of the row of threads 1–8, and that the plane produced by the reflected light beam L or L1 runs obliquely to the plane of the threads 1–8.

The mirror 13 is fixedly mounted on the front roller 14, preferably on a shoulder or other suitable point, and rotates with the front roller 14 and thereby enters the emitted light beam L upon each rotation during a certain time period, and reflects said beam as light beam L1 to the receiver E. Since the mirror 13 continues to rotate during this time period, the scanning of the individual threads 1 to 8 described with reference to FIG. 6 takes place.

In order to avoid adjustment problems with the transmitters and receiver E, the mirror 13 is preferably designed as a spherical segment.

In the case of the exemplary embodiments described, known elements, for example luminescent diodes or photodiodes are used as transmitter and receiver. The processing of electric pulses is adequately known and need not therefore be described any further. It should be mentioned, however, that the shading represents a voltage or a current pulse. Both parameters are easy to measure and can be simply converted into binary signals and are consequently ideally suited for further processing by means of electronic data processing, preferably microprocessors.

Although the invention has been described with particular reference to certain embodiments, such description is intended as exemplary only, and the scope of the invention is to be ascertained from the claims which follow.

What is claimed is:

1. Process for the production and quality monitoring of the production points on multi-spindle textile machines, the production points being arranged in rows and the thread running at each production point assuming an at least approximately stretched position in the monitoring region, characterized in that a joint monitoring element (S,E,L) is provided in each case for at least two production points (1–8) and has a bundle of rays (L) orientated transversely to the thread running direction, in that the bundle of rays is moved transversely to the thread running direction and transversely to the row of the individual production points, and thereby passes successively over the production points to be monitored and is interrupted or attenuated at each production point by the respective thread thereby producing shading pulses to be evaluated for each production point.

2. Process according to claim 1, characterized in that the bundle of rays is orientated obliquely to a line joining the individual production points (1–8) and the individual threads are scanned sequentially.

3. Process according to claim 2, characterized in that the degree of shading of the bundle of rays (L) by a thread is assessed as a measure of its cross-section.

4. Process according to claim 3, characterized in that the monitoring element (S,E,L) has a transmitter (S)

and a receiver (E) for the bundle of rays (L) and in that the shading pulses (I) occurring in the receiver during the scanning of the production points (1–8) are processed.

5. Process according to claim 4, characterized in that the bundle of rays (L) is moved at constant speed transversely to the thread running direction, so that equidistant shading pulses (1) occur at the receiver (E).

6. Process according to claim 5, characterized in that the absence of a shading pulse (I) at its intended position is assessed as thread breakage at the production point (1–8) concerned.

7. Process according to claim 4, characterized in that the amplitude (A) or the length over time of the shading pulses (I) or a combination thereof is used for the monitoring of the cross-section of the thread concerned.

8. Multi-spindle textile apparatus for processing multiple threads simultaneously comprising a plurality of work stations disposed in a row and providing at each work station a thread path extending generally transverse to the direction of extent of the row of work stations; and at least one thread monitoring system for monitoring the thread paths at a group of adjacent ones of said work stations, said system including a radiation transmitter, a radiation receiver and means for causing radiation from said transmitter to pass successively to said receiver along different radiation paths with different ones of said thread paths of said group being intersected by different ones of said radiation paths and with each of said radiation paths extending at an angle with respect to the direction of extent of said row of work stations.

9. Apparatus according to claim 8, wherein the transmitter and the receiver are arranged movably transversely to the thread running direction, and wherein this movement is performed simultaneously and synchronously.

10. Apparatus according to claim 9, including a first driveable swivel arm carrying said transmitter and a second driveable swivel arm carrying said receiver.

11. Apparatus according to claim 8, wherein the receiver is arranged fixedly and the transmitter is arranged movably.

12. Apparatus according to claim 8, including an adjustable mirror, and wherein the transmitter and the receiver are arranged and the radiation is caused to pass successively along different radiation paths by said adjustable mirror.

13. Apparatus according to claim 12, wherein the transmitter and receiver are arranged on one side of a line intersecting the thread paths at said group of work stations and the mirror is arranged on the other side of said line.

14. Apparatus according to claim 12, wherein the transmitter and receiver are arranged on different sides of a line intersecting the thread paths at said group of work stations, and wherein the apparatus includes a rotatable part which rotates as said threads are being processed and a mirror carried by said rotatable part.

15. Apparatus according to claim 14 wherein said rotatable part is a thread feed roller.

* * * * *